United States Patent [19]

Cheng et al.

[11] 3,963,858

[45] June 15, 1976

[54] HIGH-VOLTAGE ELECTRICAL INSULATOR ADAPTED TO PREVENT FLASHOVER

[75] Inventors: Tsen-Chung Cheng, Los Angeles, Calif.; Gerald L. Wilson, Wayland; David C. Jolly, Boston, both of Mass.

[73] Assignee: Massachusetts Institute of Technology, Cambridge, Mass.

[22] Filed: Apr. 21, 1975

[21] Appl. No.: 570,147

[52] U.S. Cl. ..... 174/141 R; 174/140 R

[51] Int. Cl.[2] ..... H01B 17/42

[58] Field of Search ..... 174/139, 140 R, 140 C, 174/140 H, 140 S, 140 CR, 141 R, 141 C, 142, 143, 144, 211

[56] References Cited

UNITED STATES PATENTS

| | | | |
|---|---|---|---|
| 1,166,393 | 12/1915 | Steinberger | 174/140 R |

FOREIGN PATENTS OR APPLICATIONS

| | | | |
|---|---|---|---|
| 287,607 | 12/1968 | Australia | 174/140 R |
| 17,761 | 7/1912 | United Kingdom | 174/142 |
| 202,539 | 8/1923 | United Kingdom | 174/142 |
| 212,826 | 3/1924 | United Kingdom | 174/140 R |

*Primary Examiner*—Laramie E. Askin

*Attorney, Agent, or Firm*—Arthur A. Smith, Jr.; Robert Shaw; Martin M. Santa

[57] ABSTRACT

An electrical insulator composed of one or more electrical insulating skirts or sheds or shells at least some of which skirts or sheds or shells have a plurality of discrete conductive regions at one surface thereof, the discrete conductive regions being appropriately arranged and sufficient in number to intercept an arc in the event of incipient flashover from proceeding radially past the discrete conductive regions, thereby to prevent said flashover.

16 Claims, 8 Drawing Figures

HIGH-VOLTAGE ELECTRICAL INSULATOR ADAPTED TO PREVENT FLASHOVER

The invention described herein was made in the course of or under a grant from the National Science Foundation, an agency of the United States Government.

The present invention relates to insulators that may be used, for example, on high voltage transmission lines and, in particular, to insulators to decrease the occurrence of flashover.

As used herein, the term "insulator" denotes rod-type insulators, post-type insulators, pin-type insulators, bushings, insulator strings and the like. Such insulator usually comprises a number of prcelain skirts or sheds or shells but may have cast epoxy or other synthetic material skirts or sheds or shells, as well. The terms "skirts", "sheds" and "shells" (and modifications thereof) as used herein denote the same part of the insulator.

Contamination flashover is a form of arc discharge across the moist surface of an insulator upon which has been previously deposited soluble particulates so that it has become conductive. Once the arc discharge, which usually starts either from the central cap or pin of the insulator, has bridged over the top porcelain or other insulating surface thereof and the creepage path beneath it, the insulating strength of that insulator is entirely gone. The result is that other insulators in series, in an insulator string, for example, with increased voltage stresses, will be similarly affected and eventually an outage occurs. The necessary ingredients for a flashover are moisture and contaminant substances. The former is usually supplied by nature in the form of fog, dew, rain, ice, etc. The sources of contamination can range from industrial pollution to bird droppings. A survey by an IEEE Working Group tabulated a great variety of such contaminants: "A Survey of the Problem of Insulator Contamination in the U.S. and Canada — Part I," IEEE Trans. on Power Apparatus and Systems, PAS-90, pp 2577–2585 (1971). With the presence of moisture and contamination, the flashover process is thought to occur as follows. During dry weather, pollutants are deposited on an insulating surface. When the surface becomes moist, some pollutants are dissolved and the surface starts to conduct electrically. The passage of leakage current produces ohmic heating and the area around the pin, where the electric field is highest, starts to dry out. Subsequently, a dry zone is formed around the pin and low current arcs can now bridge this zone. The heat of the arc evaporates more water, enlarging the dry zone and the arc. Sometimes, the arc lengthens to some extent and goes out. Other times, the arc grows until the insulator string is bridged and full fault current then flows, causing the circuit breakers to be tripped. This picture embodies the essence of what happens during a contamination flashover. After a flashover, the line may or may not be automatically reclosed, depending on whether the factors causing the fault have been removed or not. Frequently, it may be many minutes before the line can support voltage again. Also, quite often, the insulators involved are damaged by the arcs and must be replaced.

The propagation of arcs across the film is also very much dependent upon the insulating surface conditions. A new and clean insulator, as a rule, performs much better than an old and contaminated one. On the surface of the former, moisture tends to bead up, forming separate droplets. While, on the surface of the latter, moisture can wet the surface quite readily, thus increasing the leakage current and initiating arc discharges. The ability to maintain either a clean insulating surface or a water-repellent one has therefore become a major criterion in insulator design. Keeping an insulator clean can be accomplished by regular washing, while making the insulating surface water-resistant can be achieved by greasing.

The above description illustrates that certain necessary conditions must be satisfied in order for a flashover process to complete itself. The most important ones are contamination, moisture, leakage current, dry zone, arc initiation and arc propagation. Each is a prerequisite to the occurrence of the chain of events that leads to flashover. If somewhere along the way a vital condition is missing, then the flashover process will be stopped.

The fact that all conditions just noted must be met has pointed a way to some possible solutions of the problem. To reduce pollution, insulators have been designed to contain an oil bath so that dirt particles can be kept away from the porcelain surface. To lessen the impact of moisture, special skirts or sheds have been designed so that at least a portion of the leakage path is kept dry. Some insulators are also designed in such a way that rain can be used as a cleansing agent. External washing equipments have also been installed in heavily polluted regions so that when contamination has reached a certain level, washing starts automatically. Depending on locality, however, washing usually has to be performed fairly frequently, making it a costly operation. A more economical method probably is that of greasing the insulating surface of an insulator. Grease insures that an insulating surface stays water-repellent and needs to be re-applied only once every two years or so. Furthermore, the improvement in insulator performance is far more significant. The primary function of the grease is to break up the moist film so that surface resistance increases.

Finally, increasing the leakage path will increase the insulator performance, to some degree. However, there is some mechanical limit to the size and weight of an insulator. All of the above modifications have one thing in common — increasing the surface resistance of an insulator so that an arc will not be formed.

The initiation of an arc depends on the formation of a dry zone, as described before. If the dry zone can be widened sufficiently, then the field can be reduced significantly so that breakdown will be far less likely. This concept is utilized in the design of a semi-conductive insulator. A small current is allowed to flow on the surface to keep it dry all the time through ohmic heating. The use of a semiconductive insulator is still under active research; one of the main obstacles that must be overcome seems to be that of thermal runaway.

Comparatively little study has been done in the area of stopping an arc, once formed, from flashover. Rumeli (A. Rumeli, "The Mechanisms of Flashover of Polluted Insulation," Ph.D. thesis, University of Strathclyde, Glasgow, 1967, Department of E.E.) used the idea of gradient rings which are metallic bands taped onto the skirts of an insulator. The rings, ideally, will forcibly set the potential distribution in such a way that electric stresses will be more evenly distributed along the whole leakage path. This method has also been called "equalization of potential." The Rumeli approach also relies on the fact that the electric field is reduced considerably when it comes in contact with the metal bands. The reduction in field may retard the arc motion sufficiently to prevent a flashover. Though acceptable conceptually, the use of gradient rings has yet to be proven in practice.

Accordingly, an object of the present invention is to provide an insulator that will, when subjected to contamination and moisture under conditions of high voltage, resist flashover to a greater extent than insulators heretofore proposed.

This and still further objects are brought out hereinafter and are particularly delineated in the appended claims.

The foregoing object is achieved in an insulator that comprises an insulating skirt or shed formed in such a way that an arc in the course of flashover with respect to the skirt or shed must occur by moving generally radially across one insulating surface of the skirt or shed to the other insulating surface thereof. There is provided on or at one insulating surface of the skirt or shed, or at both surfaces thereof, a plurality of discrete conductive regions arranged in a configuration and sufficient in number to intercept an arc in the event of incipient flashover from proceeding past the discrete conductive regions. Typically, the insulating skirt or shed is circularly symmetric; the discrete conductive regions are conductive regions which are conductive spheroids or the like secured to an insulating surface of the skirt or shed and spaced from one another along a circular circumferential path. Hence, any arc that might form in the event of incipient flashover would move across one insulating surface from the center of the insulator toward the periphery thereof, past the conductive spheroids, thence to the other insulating surface, toward the insulator center. In the present device, that arc is intercepted by the conductive spheroids.

The invention is hereinafter explained with reference to the accompanying drawing in which.

Figure 1:
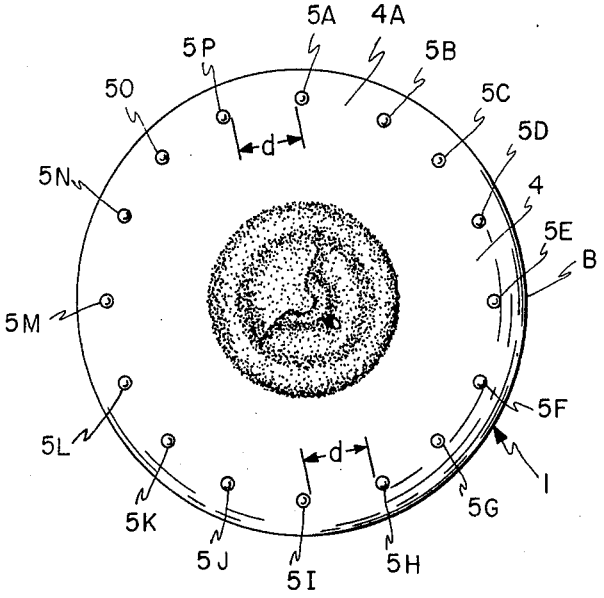
FIG. 1 is a top view of an insulator having a single insulating skirt or shed with sixteen conductive spheroids secured near the periphery of the circularly symmetric insulating skirt or shed.

Before going into a detailed discussion of the several embodiments of the invention herein disclosed, there is given in this and the next two paragraphs, a brief, preliminary overall explanation. The present invention has meaning mostly with regard to high voltages, above, say 100,000 volts, but can be useful at lower voltages. In any event, as is well known in the art, the function of an insulator is to isolate a point or region at one electric potential from a point or region at another electric potential. Thus, with reference to FIG. 4, for example, an insulator string 101 serves to insulate an arm 102 from a conductor 103, as later explained, that is, the insulator string acts to prevent flashover from occurring between the conductive arm 102 and the conductor 103.

All the embodiments herein serve the same general functions but slightly differing terms have arisen in the art to describe the structural parts of different-type insulators. By way of illustration, the insulator string 101 is in the context of the present specification and in the art appropriately called an insulator without further qualification and performs the same function as the pin-type insulator shown at 105 in FIG. 6, the post-type insulator shown at 106 in FIG. 7 and the rod-type insulator shown at 107 in FIG. 8, as well as a bushing (or bushing insulator), not shown. As later described herein, the insulator string 101 consists of a plurality of insulators 1A . . . 1N like the insulator shown at 1 in FIGS. 1–3 and each includes what is called a shell or electrically insulating shell herein (e.g., the shell labeled 4 in FIGS. 1–3). The function of the insulating shells of the insulators 1A . . . is identical to that of shells or skirts or sheds 40A, 40B . . . of the pin-type insulator 105, or the skirts or sheds labeled 41A, 41B . . . of the post-type insulator 106 or 42A, 42B . . . of the rod-type insulator 107. In each case in an operating system, an arc in the course of flashover with respect to each insulating shell (or each insulating skirt or shed) must occur by moving generally radially across one surface of the shell (or skirt or shed) to the other surface thereof. By way of illustration and with reference to FIGS. 1–3, flashover, if it occurs, will be in the form of an arc that starts at a conductive cap 2 and moves generally radially across the upper surface labeled 4A of the shell 4 to the lower surface 4B thereof and thence to a conductive pin 3 (or vice versa). All the insulators herein disclosed have a plurality of discrete conductive regions disposed at least at one insulating surface of the shell 4 (or skirt or shed) and arranged in a configuration and sufficient in number to intercept an arc in the event of incipient flashover from proceeding radially past the discrete conductive regions at the one surface to the other surface of the shell, thereby to prevent flashover.

Figure 2:
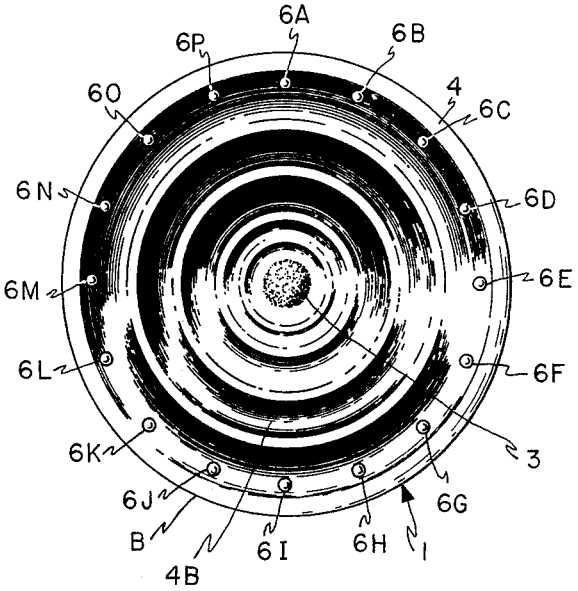
FIG. 2 is a bottom view of the insulator of FIG. 1 and shows sixteen conductive spheroids secured to the underside of the skirt of shed near the pheriphery.
Figure 3:
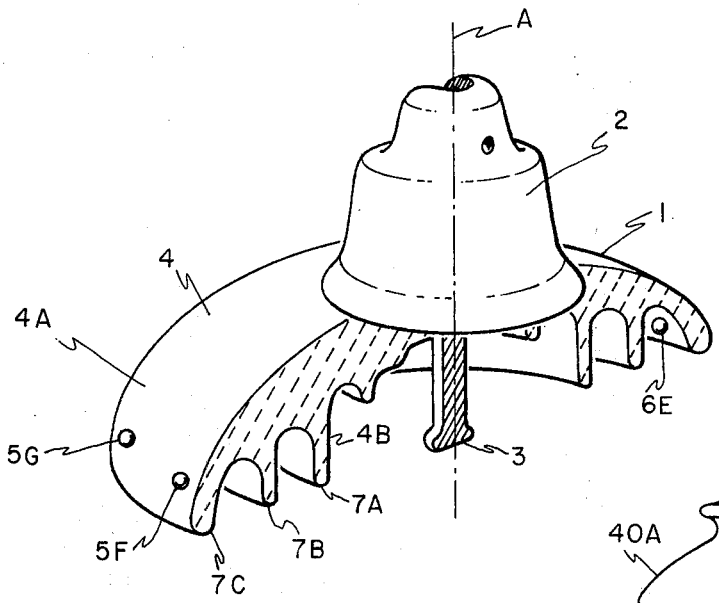
FIG. 3 is an isometric section view of the insulator of FIG. 1.

In order to provide some perspective to the present explanation, the representations shown in FIGS. 1–3 are of a single actual insulator 1. The actual insulator is circularly symmetric, as best shown in FIGS. 1 and 2, and has a radius R of about 5 inches; the discrete conductive regions consist of sixteen stainless steel ball bearings 5A . . . 5P at the upper surface 4A of the shell 4 and sixteen steel balls 6A . . . 6P at the lower surface 4B thereof. The ball bearings are 9/32 inches in diameter. The circumferential spacing, marked *d* in FIG. 1, between the conductive regions is about 1½ inches. Experience to date indicates the conductive regions 6A . . . 6P to be more important for present purposes than the regions 5A . . . 5P.

Figure 4:
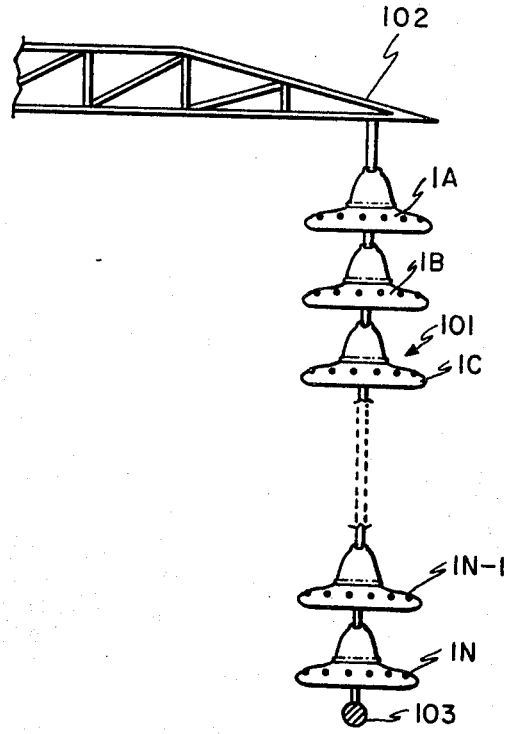
FIG. 4 shows a plurality of insulators, similar to the insulator of FIG. 1, in the form of an insulator string hanging from the arm of a transmission tower.

Turning now to FIG. 4 the insulator string 101 is strung from the arm 102 of a transmission line tower (not shown) and supports one line 103 of a high voltage transmission line which can be several thousand to a million or more volts. Since, as above noted, each of the insulators 1A . . . can be, and usually are, identical, the discussion that follows is with reference to the single insulator in FIGS. 1–3.

The insulator 1 consists of the metallic cap 2 which acts in combination with the conductive pin 3, as is well known, in the formation of an insulator string. The insulator 1 further includes an insulating shell (the shell 4) which is ordinarily composed of a ceramic insulating material and which is circularly symmetric as best shown in the top and bottom views of FIGS. 1 and 2, respectively. In order to simplify the explanation here and to permit specificity in the claims, a few terms are now defined. As used in this specification, the axis of the insulator 1 is the line labeled A in FIG. 3 and that is also the axis of the string 101. The periphery or the outer edge of the shell 4 is labeled B and is at the perimeter of the circular shell.

The present invention is concerned with distributing conductive spheriods between the axis (or center) A and the periphery B and, usually, placing such spheroids near the periphery B. The spheroids can be secured to the top surface of the shell 4 as are the sixteen conductive spheroids labeled 5A . . . 5P in FIG. 1 or they can be secured to the underside as are the sixteen conductive spheroids 6A, 6B . . . 6P in FIG. 2. The conductive spheroids in each instance project outwards from the respective surface, but need not do so. The insulator 1 has first, second and third (or outer) petticoats 7A, 7B and 7C, respectively, at its under or lower side and the balls 6A . . . are secured in the valley between the third (or outer) petticoat 7C and the second skirt 7B. Further spheroids, fewer in number, can be secured between the petticoats 7B and 7A. The number of spheroids depends on the size of the insulator 1. In the insulator herein discussed, as above noted, the spheriods 6A . . . (and the spheroids 5A . . . ) are ball bearings 9/32 inches in diameter and they are placed at a radius of three inches from the axis A. Tests were made on flat plate insulators with sixteen balls at a three-inch radius (at the upper surface) and on an insulator like the insulator 1. The results gave an increase of ten to twenty percent in the threshold voltage for flashover when compared with identical insulators without the spheroids — a significant increase.

A number of conclusions were reached from the work. If there are too few balls, then the arc can go through the circumferential gap between the balls easily. In some cases, even a slightly unsymmetric distribution of the balls will allow an arc to sneak through the largest gap. The criterion is that the balls must be close enough (i.e., *d* must be small enough) but not too close to form an equipotential ring. An inter-ball separation of about two-to-three ball diameters seems to work quite well. In addition, the distance between a ball and the center electrode (i.e., the pin 3 or the cap 2) should not be too large or too small. If it is too large, then the balls lose their effectiveness as will be shown later. If it is too small, then it could even cause a flashover. Work done to date indicates that conductive spheroids protruding from the lower surface of the porcelain shell 4 have great effect and that the spheroids 5A . . . protruding from the upper surface have a lesser effect.

The placing of the balls is, of course, determined by the theory of operation which is now proposed here. Essentially, the objective is to inhibit arc propagation and, eventually, arc initiation. One way to stop an arc from starting from the center electrode (or pin) 3 is to create a dry zone of sufficient width so that no arc can bridge across it. In order to achieve this, one method is to keep the arcs burning in a confined region for a while until a much larger dry zone has been formed and the arcs will then extinguish themselves. Thus, a method has to be found such that initial arcs, once formed, will not travel, radially, the whole leakage path to cause flashover, but, rather, will be confined within a certain radius only.

The outwardly extending steel spheroids or balls work very well as a means of confining the arcs and eventually creating a large enough dry zone. The process is as follows. When a voltage is applied to the insulator 1, a small dry zone forms around the center electrode or pin 3. Arcs are then initiated across the dry zone and travel radially outward. When an arc hits one of the spheroids, the field intensification around the spheroid induces a concentration of leakage currents so that a small dry zone is formed around that spheroid itself. The dry zone thereby formed around the spheroid increases quite considerably the resistance the arc must overcome to complete a flashover. The momentary delay in the radial propagation of the arc will enlarge the dry zone even more as currents continue to flow and further reduces the chance for forward motion. Subsequently, another arc will now hit another one of the spheroids. A similar process now occurs around the second spheroid and the second arc is extinguished. The whole process then repeats itself many times until nearly all the spheroids have dry zones around them. At that juncture, the dry zone around the center pin 3 will have expanded considerably. With more or less the same voltage across a much wider dry zone, arcing activities can be expected to subside drastically, reducing chances for a flashover. The main features of the novel insulator herein disclosed are thus the following. The arcs must be induced to travel in such manner that they hit one spheroid and then another in succession. Once the arcs are thus confined within the ring of spheroids, they can be expected to create a large dry zone and, hence, stop arcing altogether. The optimum design thus calls for placing the balls at such a distance from the center pin 3 that the subsequent dry zone formed will ensure that arcing can be inhibited completely.

Since the process of arc initiation and propagation is a very complicated phenomenon, other factors may also be playing a part. A few of those factors are mentioned here for the sake of completeness. The propagation of an arc depends much upon the efficiency of ionization at the arc tip. When an arc hits one of the spheroids, since it cannot penetrate the spheroid, it will have to "go over" it, which requires extra energy to start from another spot on the spheroid. Since the spheroid has a smooth surface, field intensification is greatly reduced and the prospect of initiating an arc from the surface is reduced considerably. Further, the steel spheroids used, being nearly perfect conductors, will actually reduce the electric field immediately next to their surfaces. This reduction further inhibits arc propagation.

Other factors may also be present to affect the arc propagation in this particular configuration. However, their roles are thought to be of secondary importance.

Figure 5:
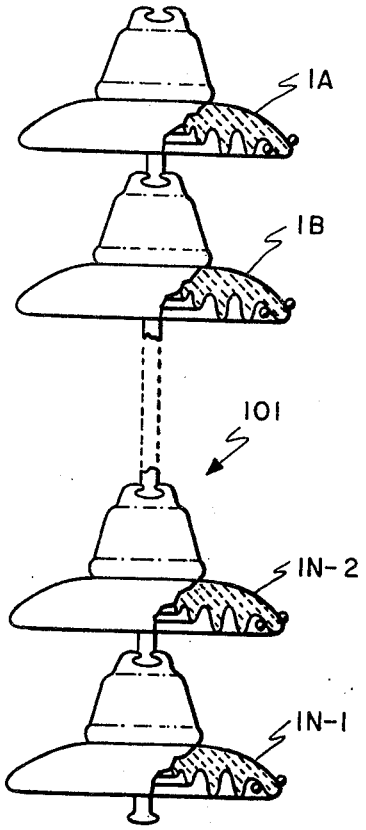
FIG. 5 is a side view, on an enlarged scale and partly cutaway, of an insulator string like that in FIG. 4.

The above explanation centers mostly around the single unit 1 in FIGS. 1–3 which is assembled to form the string insulator of FIGS. 4 and 5. The concepts herein disclosed can be used in connection with bushings, as may be used for transformers, circuit breakers, etc., as well as for the pin-type insulator in FIG. 6 and the post-type insulator of FIG. 7 and the rod-type insulator of FIG. 8.

Figure 6:
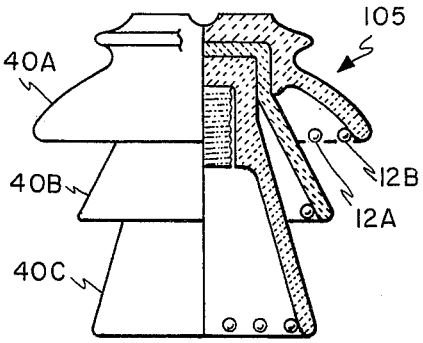
FIG. 6 is a side, cutaway view of a pin-type insulator embodying the present inventive concepts.

With reference now to FIG. 6, the pin-type insulator 105 is composed of the insulating shells 40A . . . , as above noted, which are secured together in a stacked configuration. Each shell has secured at the undersurface thereof conductive spheroids of which only the spheroids marked 12A and 12B at the under surface of the shell 40A are labeled.

Figure 7:
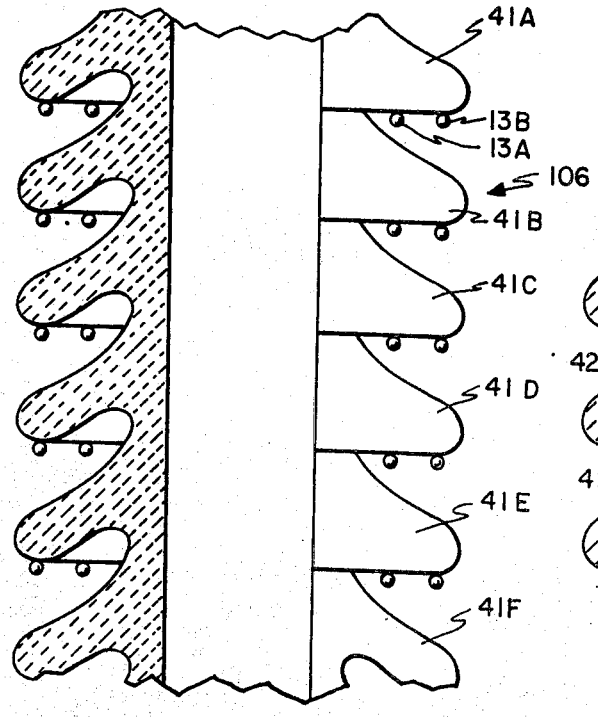
FIGS. 7 and 8 are side, cutaway, partial views respectively of a post-type insulator and a rod-type insulator embodying the present inventive concepts.
Figure 8:
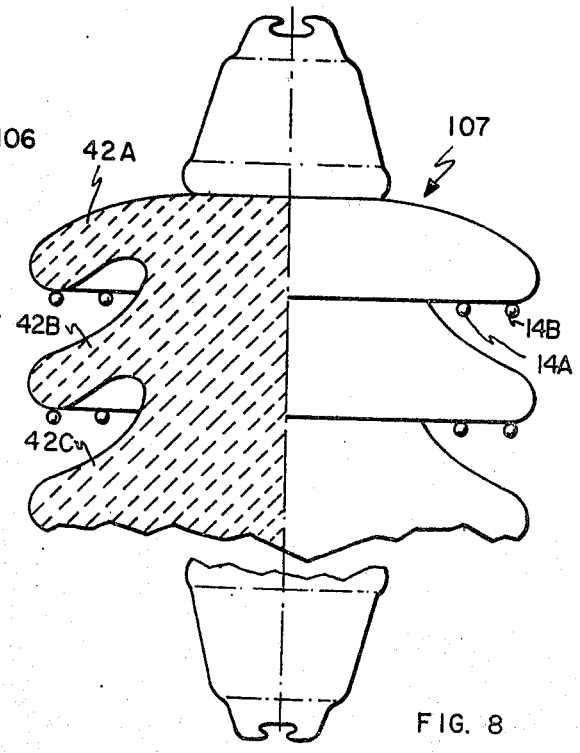

Whereas the string insulator 101 and the pin-type insulator 105 are formed by combining a number of individual units or shells, the post-type insulator 106 and the rod-type insulator 107 are unitary structures which may be formed of ceramic but often, now, are cast epoxy structures having a slightly differently shaped skirt or shed than that shown in FIGS. 7 and 8. Again, the conductive spheroids are located at the underside of the skirts or sheds of the respective insulators, only spheroids 13A and 13B as to the insulator 106 and spheroids 14A and 14B as to the insulator 107 being marked in the figure.

Modifications of the invention herein disclosed will occur to persons skilled in the art and all such modifications are deemed to be within the spirit and scope of the invention as defined by the appended claims.

What is claimed is:

1. An insulator that comprises, in combination: electrically insulating shell means having a convex upper surface and a concave lower or under surface formed in such a way that an arc in the course of flashover with respect to the shell means must occur by moving generally radially across one surface and to the other surface; and a plurality of discrete, circumferentially-spaced conductive regions disposed at one said surface and arranged in a configuration and sufficient in number to intercept an arc in the event of incipient flashover from proceeding radially past the discrete conductive regions at the one said surface of the shell, thereby to prevent said flashover, the entire exposed portion of each discrete conductive region having a smooth surface to reduce electric field intensification and to reduce the prospect of initiating an arc.

2. An insulator as claimed in claim 1 in which the shell means is a circularly symmetric shell and in which each discrete conductive region is a discrete smooth-surfaced conductor, the discrete smooth-surfaced conductors being located between the center of the insulator and the periphery thereof, the circumferential spacing between the discrete smooth-surfaced conductors being sufficiently small to assure interception of an arc and prevent radially directed flashover and the distance between each of the smooth-surfaced conductors and said center being small enough to render them effective to intercept the arc but large enough not to cause the arc.

3. An insulator as claimed in claim 2 in which the discrete smooth-surfaced conductors are arranged to lie along a generally circular path.

4. An insulator as claimed in claim 3 in which said discrete smooth-surfaced conductors each comprises a conductive spheroid.

5. An insulator as claimed in claim 4 in which the insulating shell means comprises a circularly symmetric ceramic shell and in which the conductive spheroids are located at the underside of the ceramic shell.

6. An insulator as claimed in claim 5 which has also, spheroids at the upper surface of the shell arranged to lie along a generally circular path.

7. An insulator string that comprises a plurality of units, each unit comprising a metallic cap, a metallic pin and a circularly symmetric shell as claimed in claim 2 with said discrete smooth-surfaced conductors at the surface thereof.

8. An insulator string as claimed in claim 7 in which the shell is a circularly symmetric porcelain shell having a plurality of concentric annular petticoats at the under surface thereof and in which the discrete smooth-surfaced conductors are located inside the outer petticoat of the plurality of petticoats and are positioned to lie along a generally circular circumferential path.

9. An insulator string as claimed in claim 8 in which each discrete smooth-surfaced conductor is a conductive spheroid.

10. A pin-type insulator that comprises a plurality of shells as claimed in claim 2 with said discrete smooth-surfaced conductors at one surface thereof, said units being secured together in a stacked configuration.

11. An insulator that comprises, in combination, a plurality of electrically insulating skirts or sheds formed in such a way that an arc in the course of flashover with respect to each skirt or shed must occur by moving generally radially across one surface of the skirt or shed to the other surface thereof; and a plurality of discrete, circumferentially-spaced, conductive regions disposed at one surface of at least one skirt or shed and arranged in a configuration and sufficient in number to intercept an arc in the event of incipient flashover from proceeding radially past the discrete conductive regions at the one surface to the other surface of the skirt or shed, thereby to prevent said flashover, said plurality of electrically insulating skirts or sheds being formed in a post-type insulator configuration, the entire exposed portion of each discrete conductive region having a smooth surface to reduce electric field intensification and to reduce the prospect of initiating an arc.

12. An insulator that comprises, in combination: a plurality of electrically insulating skirts or sheds formed in such a way that an arc in the course of flashover with respect to each skirt or shed must occur by moving generally radially across one surface of the skirt or shed and to the other surface thereof; and a plurality of discrete, circumferentially-spaced, conductive regions disposed at one surface of at least one skirt or shed and arranged in a configuration and sufficient in number to intercept an arc in the event of incipient flashover from proceeding radially past the discrete conductive regions at the one said surface to the other surface of the skirt of shed, thereby to prevent said flashover, said plurality of electrically insulating skirts or sheds being formed in a rod-type insulator configuration, the entire exposed portion of each discrete conductive region having a smooth surface to reduce electric field intensification and reduce the prospect of initiating an arc.

13. A rod-type insulator as claimed in claim 12 in which each skirt or shed is circularly symmetric and in which each said discrete conductive region is a discrete smooth-surface conductor, the discrete smooth-surfaced conductors being located between the center of the insulator and the periphery thereof, the circumferential spacing between the discrete smooth-surfaced conductors being sufficiently small to assure interception of an arc and prevent radially directed flashover.

14. A rod-type insulator as claimed in claim 13 in which the discrete smooth-surfaced conductors are arranged to lie along a generally circular path.

15. A rod-type insulator as claimed in claim 14 in which the discrete smooth-surfaced conductors each comprises a conductive spheroid, in which the conductive spheroids are located at the under side of the skirt or shell and arranged to lie along a generally circular path.

16. An insulator that comprises, in combination: a plurality of electrically insulating skirts or sheds formed in such a way that an arc in the course of flashover with respect to each skirt or shed must occur by moving generally radially across one surface of the skirt or shed to the other surface thereof; and a plurality of discrete, circumferentially-spaced conductive regions disposed at one surface of at least one skirt or shed and arranged in a configuration and sufficient in number to intercept an arc in the event of incipient flashover from proceeding radially past the discrete conductive regions at the one surface to the other surface of the skirt or shed, thereby to prevent said flashover, the entire exposed portion of each conductive region having a smooth surface to reduce electric field intensification and to reduce the prospect of initiating an arc.

* * * * *